United States Patent [19]

Currier et al.

[11] Patent Number: 4,734,969

[45] Date of Patent: Apr. 5, 1988

[54] FLOATING ROD LACER FOR AUTOMATIC COIL ASSEMBLY

[75] Inventors: William R. Currier; Randall D. Booker, both of Indianapolis, Ind.

[73] Assignee: Carrier Corporation, Syracuse, N.Y.

[21] Appl. No.: 919,733

[22] Filed: Oct. 16, 1986

[51] Int. Cl.[4] ..... B21D 53/02

[52] U.S. Cl. ..... 29/157.3 B; 29/157.3 C; 29/726

[58] Field of Search ..... 29/157.3 A, 157.3 C, 29/157.3 B, 157.3 R, 726, 727, 33 G, 33 T, 33 P, 235, 272, 281.4, 282, 794, 796, 822

[56] References Cited

U.S. PATENT DOCUMENTS 4,228,573 10/1980 Barnard ..... 29/177.3 B
4,547,952 10/1985 Greever et al. ..... 29/727
4,584,751 4/1986 Gray et al. ..... 29/157.3 C

*Primary Examiner*—Howard N. Goldberg
*Assistant Examiner*—Irene Cuda
*Attorney, Agent, or Firm*—Dana F. Bigelow

[57] ABSTRACT

A method and apparatus for lacing hairpin tubes into plate fin bundles by the continuous movement of plate fins from one end of horizontally supported guide rods to the other end thereof where they pass onto aligned tubes. The horizontal guide rods are precisely positioned by a number of clamps applied along their lengths. Provision is made to successively remove and reapply the clamps in such a way as to permit the selective movement of the fins along the guide rods while maintaining the guide rods in their fixed positions. The guide rods are graduated in various diameters to facilitate the easy movement of the plate fins and hairpin tubes thereon while providing for precise relative placement of the plate fins and the hairpin tubes.

26 Claims, 4 Drawing Sheets

FLOATING ROD LACER FOR AUTOMATIC COIL ASSEMBLY

BACKGROUND OF THE INVENTION

This invention relates generally to heat exchanger coils and, more particularly, to a method and apparatus for the assembly of plate fin heat exchanger coils.

A plate fin heat exchanger coil is commonly constructed with a plurality of flat, parallel plates having laterally spaced holes therein for receiving refrigerant tubes, or hairpin tubes, therein. At each end of the plate fin bundle, there is a tube sheet composed of heavier material, and adjacent the upper tube sheet, the open ends of the hairpin tubes are fluidly connected by way of U-shaped return bends that are secured thereto by way of brazing or the like. When the coils are installed into a refrigeration system, the refrigerant is made to flow through the hairpin tubes, and the air to be cooled or heated is made to flow over the plate fins, such that a heat transfer is thereby affected.

In the assembly of plate fin heat exchangers, it is known to receive the individual plate fins from the plate fin harvester and to stack them on a rod assembly for subsequent transfer, as a bundle, to the plurality of hairpin tubes. Traditionally, much of this process has been accomplished manually by an operator. This can be tedious and time consuming when considering the successive requirements of: accumulating the exact number of plate fins in a bundle; maintaining the proper orientation of the plate fins while moving them into registration with the hairpin tubes; maintaining the exact number of hairpin tubes in the proper arrangement and orientation for registration with the plate fins; and lacing each of the hairpin tubes into the fin bundle to form the coil structure. In this regard, it should be understood that the holes formed in the plate fins are only very slightly larger than the hairpin tubes in order to minimize the subsequent required expansion of the tubes into a tight fit, heat exchanging relationship with the plate fins. Accordingly, the control of the relative positions of the plate fins and the hairpin tubes during assembly is very critical.

One approach that has been used with some success is that of feeding the plate fins into one end of a chute which closely surrounds the edges of the plate fins to thereby precisely maintain their orientation, such that when they emerge at the other end of the chute they can have the precisely positioned hairpin tubes laced into them. However, such an approach has been found to be impractical where the plate fins are very thin and not likely to remain on edge during movement through the chute.

It is therefore an object of the present invention to provide an improved method and apparatus for the assembly of a plate fin heat exchanger.

Another object of the present invention is the provision for an improved method and apparatus for accumulating, orienting, and transferring an exact number of plate fins to a position where they can be assembled onto a plurality of hairpin tubes.

Yet another object of the present invention is the provision for an improved method and apparatus for automatically lacing a plurality of hairpin tubes into a fin bundle.

Still another object of the present invention is the provision for an automatic plate fin lacing method and apparatus which is economical and practical in use.

These objects and other features and advantages become more readily apparent upon reference to the following description when taken in conjunction with the appended drawings.

SUMMARY OF THE INVENTION

Briefly, in accordance with one aspect of the invention, a plurality of guide rods are maintained in selected parallel positions by way of support means. Apparatus is provided to isolate and accumulate a specified number of plate fins on one end of the rods and to subsequently transfer the resulting bundle from the other end thereof to the plurality of hairpin tubes adjacent thereto. The support means is so designed as to be selectively applied to and removed from the rods to accommodate the selected movement of the fins along the rods, while at the same time maintaining the rods in their aligned positions.

In accordance with another aspect of the invention, the support means comprises a plurality of arms that are located under the rods and are individually applied and removed by pivoting them upwardly or downwardly, respectively.

By yet another aspect of the invention, the pivotal arms of the support means are made to accurately register with the horizontal rods by way of longitudinal grooves formed in the horizontal bars. The pivotal arms have replaceable inserts at their ends for engagement with the rod grooves.

By still another aspect of the invention, the plate fin bundle is transferred from the guide rods to the hairpin tubes by first fitting the open ends of the hairpin tubes over a portion of the guide rods, and then moving the plate fins forward until the hairpin tubes are laced into them. A first graduated section on the rods causes the plate fins to pass from a smaller radius portion where the plate fins slide easily to a larger radius portion where the plate fins fit tightly on the rods and are thereby brought into precise position for engaging the hairpin tubes. A second graduated section toward the ends of the rods causes the hairpin tubes to pass from a smaller radius portion to a larger radius portion to thereby precisely position the hairpin tubes. A step is provided in each of the rods so that when the tubes are in their furthest advanced positions the ends thereof are in abutment with the step to thereby provide a smooth continuous surface for the plate fins to pass over as they move from the rods to the hairpins.

By yet another aspect of the invention, the apparatus for moving the plate fins onto the horizontal rods, and for transferring them to the hairpin tubes comprises a plurality of rake mechanisms with each such rake operating within a particular zone, the first zone being that area between the fin harvester and a longitudinal position on the bars, and the last zone being the lacing position between a final longitudinal position on the bars and a longitudinal position on the hairpin tubes.

In the drawings hereinafter described, a preferred embodiment is depicted; however, various other modifications and alternate constructions can be made thereto without departing from the true spirit and scope of the invention.

A BRIEF DESCRIPTION OF THE DRAWINGS

DESCRIPTION OF THE PREFERRED EMBOIDMENT

Figures 1, 8:
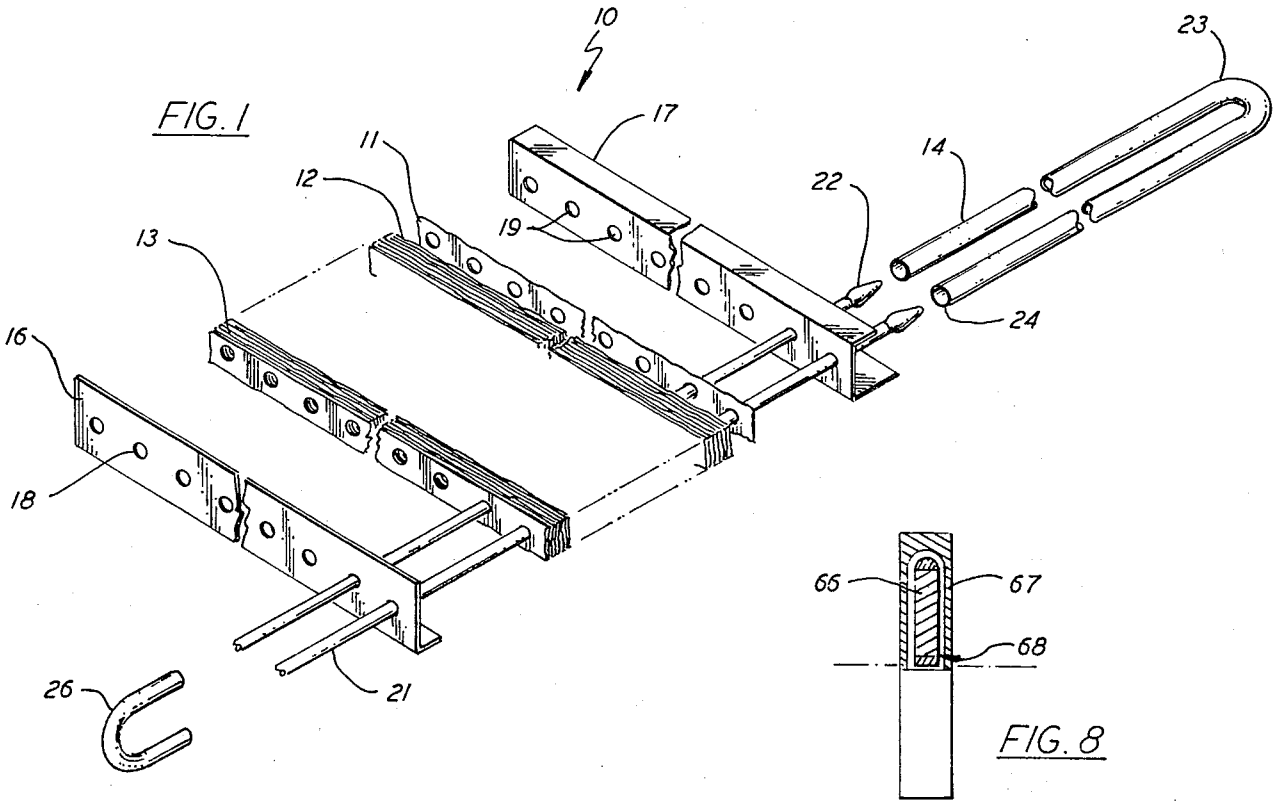
FIG. 1 is an exploded view of a portion of the plate fin coil as it is being assembled in accordance with the present invention.
FIG. 8 is a top sectional view thereof as seen along line 8—8 of FIG. 7.

Referring now to FIG. 1, there is shown a portion of a plate fin coil with the various components that are assembled in accordance with the method and apparatus of the present invention. Individual plate fins 11, having a single row of holes 12 formed therein, are stacked in a bundle 13 with their holes 12 in axial alignment for receipt of hairpin tubes 14 therein. The individual plate fins 11 are relatively thin (i.e., in the range of 0.0045 inches thick) and are stacked in relatively high density configuration (e.g., in the range of 20 fins per inch), by means of self spacing collars at each tube hole 12. At the ends of the tube bundle 13 are the upper, or return bend, tube sheet 16 and the lower, or hairpin, tube sheet 17 having the single rows of holes 18 and 19, respectively which are aligned with those in the plate fins 11. In general, the coil 10 is assembled by accumulating the plate fins 11, in a stacked relationship as shown, on parallel guide rods, two of which are shown at 21. The tube sheets 16 and 17 are then installed onto the guide rods 21 and, with the use of the tapered ends 22 which will be more fully described hereinafter, the guide rods 21 are simultaneously withdrawn and replaced with the hairpin tubes 14, with each adjacent pair of tubes 14 being interconnected by a U-shaped portion 23 at the one end as shown. The refrigerant tubes 14 are then expanded, such as by mechanically forcing a "bullet" into the internal bore, to thereby displace the outer surface of the tube into a tight fit relationship within the holes 12 to promote a good heat transfer relationship therebetween. The refrigerant circuit is then completed by connecting the open ends 24 of the hairpin tubes 14 by way of a U-shaped "return bend" 26, which is attached thereto by brazing or the like.

The present invention is involved with that part of the process wherein the plate fins 11 are accumulated into a bundle on the guide rods 21 and wherein the bundle 13 is transferred to the hairpin tubes 14. The method and apparatus to be described herein accomplishes these steps automatically to thereby achieve the objectives stated hereinabove.

Figure 2:
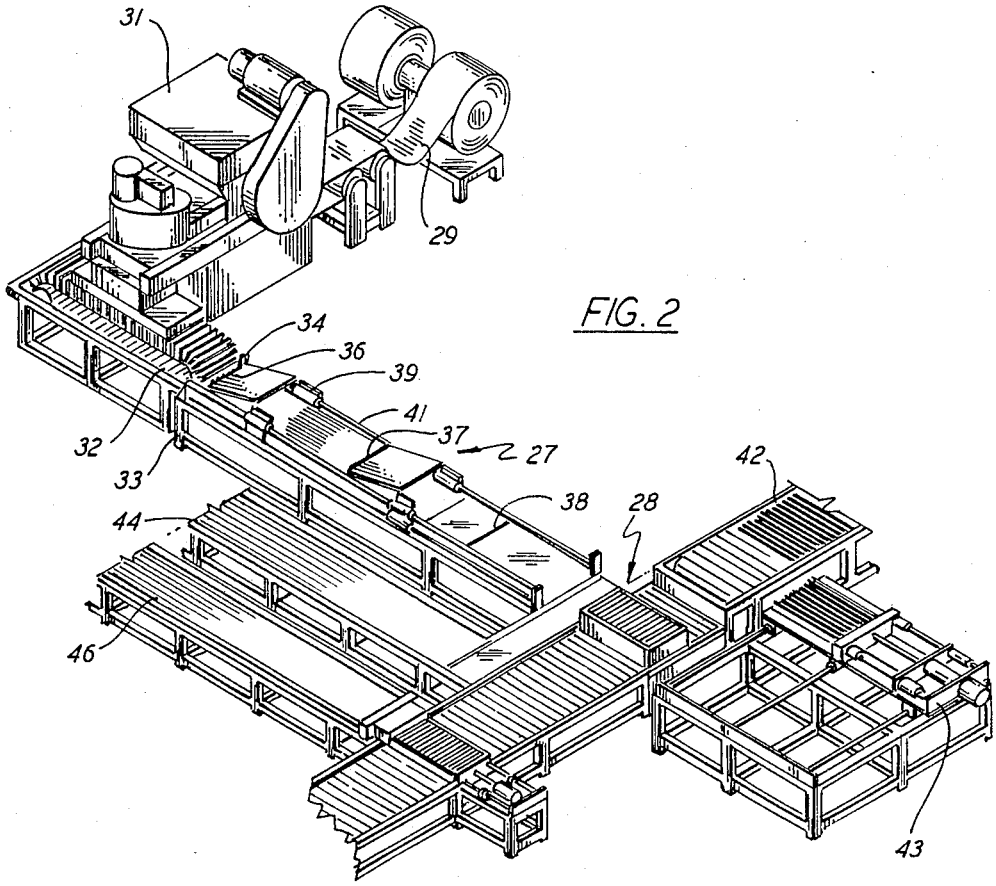
FIG. 2 is a perspective view of a plate fin assembly apparatus including the floating rod lacer portion of the present invention.

These objectives are accomplished by way of the floating rod lacer mechanism 27 shown in FIG. 2, which acts to accumulate, orient, and transfer a predetermined number of plate fins to a lacing station 28 where the hairpin tubing is laced into the fin bundle along with the tube sheets on either end thereof.

Preliminary to the assembly of the coil, the individual plate fins 11 are cut and formed from a row of flat stock 29 by way of a fin press 31. Aluminum has been found to be a suitable material for use as the stock. As the material is passed through the fin press 31 the individual plate fins 11 are produced and are then accumulated at the fin harvester 32 where they are then presented to the floating rod lacer mechanism 27 to be processed in accordance with the present invention.

As will be seen in FIG. 2, the floating rod lacer mechanism 27 comprises a relatively long flat table 33 for receiving plate fins 11 from the fin harvester 32 at its one end 34 and transporting them longitudinally to the lacing station 28 as a bundle. The positions and orientations of the plate fins are maintained by way of a plurality of guide rods which are supported in a novel manner to be described more fully hereinafter.

The plate fins are moved along the length of the table 33 by a series of rakes which are selectively raised and lowered into their operating positions so as to coincide with the operation of the guide rod support means. The rakes 36, 37 and 38 extend transversely across the table such that when they are individually lowered into position behind one of the plate fins, and are subsequently moved longitudinally along the table by way of a suitable drive means such as with a drive mechanism 39 and screw shaft 41 as shown, the group of plate fins within its operating zone is caused to move along the guide rods to the adjacent zone along the table. The rake is then raised and returned to its original position where it fetches another group of plate fins. In the second zone, for example, the groups of fins are stacked until the desired number have been accumulated, after which the second rake 37 then acts to move the plate fins into zone 3 where they are made ready for the lacing operation. The third rake 38 then operates to move the bundle onto the hairpin tubes that have been preassembled into the desired positions in precise alignment with the guide rods.

Prior to arriving at the lacing station 28, the hairpin tubes, having been cut from a roll of stock and straightened and formed, are moved toward the lacing station 28 on a conveyor 42 as shown in FIG. 2. They are then transferred (in precise compartments which maintain their exact required contour) to a shuttle mechanism 43 where they are indexed to be in the proper sequence and alignment for engagement with the awaiting tube bundle at the lacing station 28. Because of the placement of the lower tube sheet 17 between the bundle 13 and the U-shaped portion 23 of the hairpin tubes 14, it is necessary to install the lower tube sheet 17 on the guide rods 21 before the hairpins 14 are laced into the bundle 13. Accordingly, the lower tube sheet accumulator and placement station 44 is located as shown and operates to place the tube sheet onto the hairpins before the fins are laced. After the lacing operation, the upper tube sheet 16 is installed on the assembly from the upper tube sheet accumulator and placement station 46. The coil then passes along the line to the expansion and belling stations, and finally to the station where the return bends 26 are brazed onto the open ends of the hairpin tubes 14.

Figure 3:
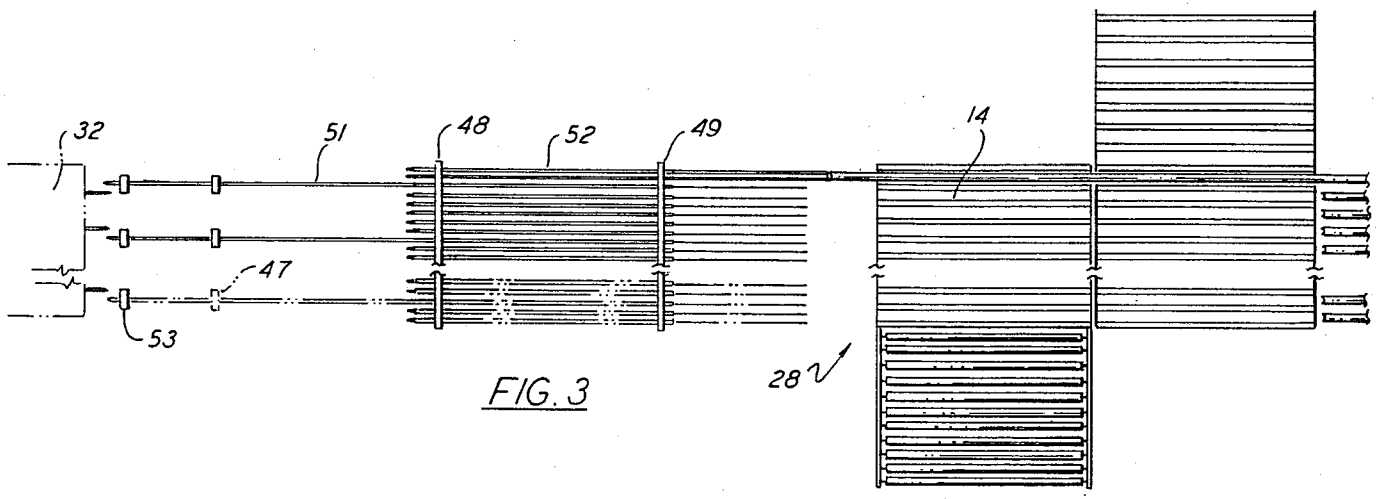
FIGS. 3 and 4 are top and side views of the floating rod lacer portion of the present invention.
Figure 4:
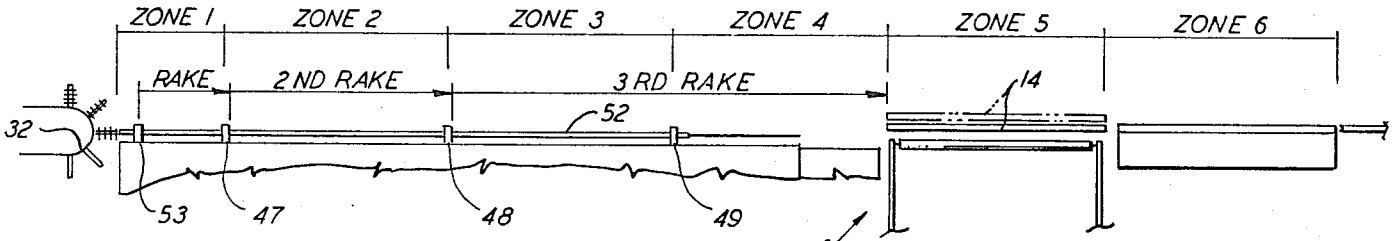

With reference to FIGS. 3 and 4, the operation of the floating rod lacer mechanism 27 will now be described. Attached to the table (not shown) in a manner which allows them to be projecting upwardly to support the guide rods or retracted below the table to permit the plate fins to be transferred freely along the length of the guide rods, there are three rows of clamps indicated generally at 47, 48 and 49. The clamps act to support and hold a plurality of long guide rods 51 and a greater number of short guide rods 52 above the table. It is the purpose of the longer rods 51 to receive the plate fins 11 from the fin harvester 32 and to accumulate and position those plate fins for subsequent registry with the short rods 52, there being a short rod for each of the holes in the plate fin. All of the rods have their ends tapered so as to facilitate the easy transfer of the plate fins onto the rods and for easy engagement with the hairpin tubes to transfer the plate fin bundles from the short rods 52 to the hairpin tubes 14.

It will be understood that in order to provide for the proper registry at the lacing station 28, the clamps 47, 48 and 49 must very accurately hold the guide rods on their center lines. However, they must also be selectively unclamped from the rods and be retracted below the working surface of the table as the fins are moved on the rods from zone to zone. The clamping and unclamping is therefore done successively such that there are no two consecutive clamps that are open at the same time. In addition to the clamps 47, 48 and 49, there is also a retractable support 53 under the unsupported ends of the long rods within zone 1. These supports make the accumulation of the fins possible while the number one clamps are open.

The rakes 36, 37 and 38, which are shown in FIG. 2, are not shown in FIGS. 3 and 4. Rather, their zones of operation are shown in FIG. 4. As mentioned hereinabove, it is the function of the rakes to move the fins along the guide rods until the hairpin tubes are laced into them. The #1 rake moves the fins from zone 1 into the second or accumulation zone. The #2 rake moves the fins from zone 2 into zone 3 where they form a bundle on the short rods 52. The rake #3 then moves the fin bundle into zone 4 where the far end of the rods engage the hairpin tube ends in a manner to be more fully described hereinafter. As mentioned hereinabove, the rakes are preferably supported and actuated by a mechanism located over the table.

Figure 5:
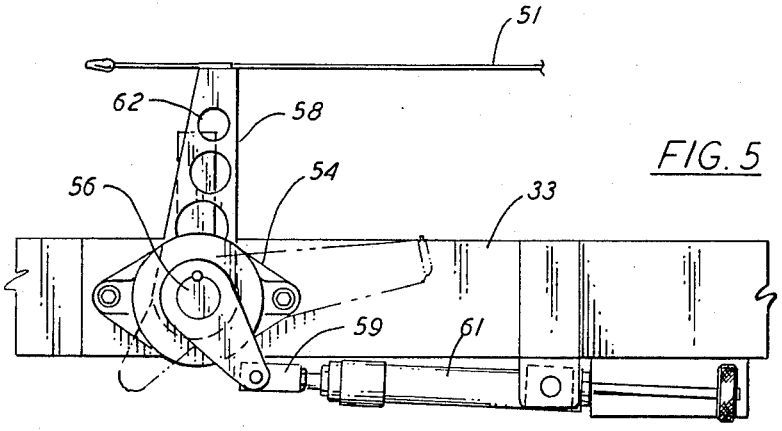
FIGS. 5 and 6 are side elevational views of the support mechanism portion of the present invention.
Figure 6:
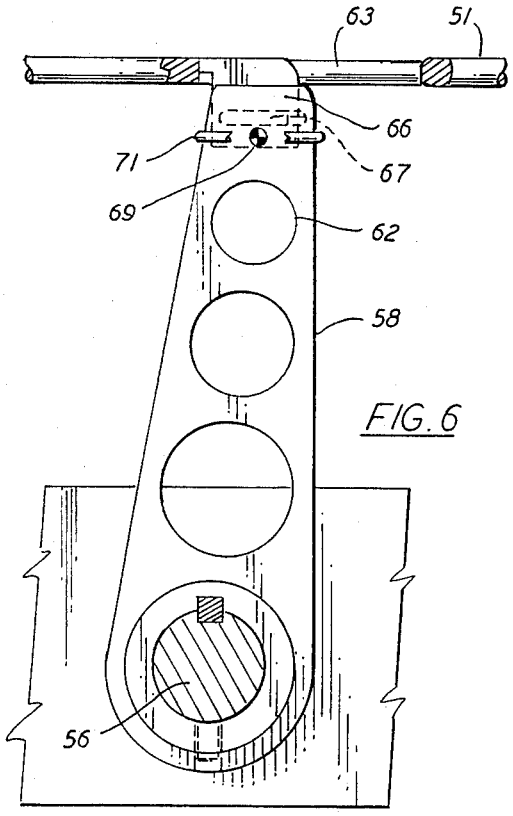
Figure 7:
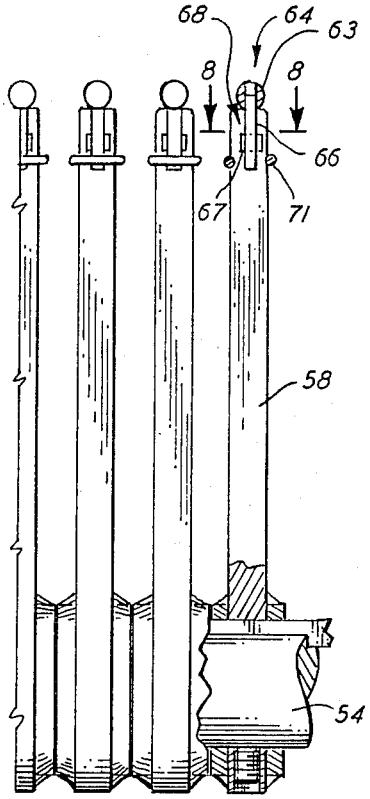
FIG. 7 is an end view thereof.

Referring now to FIGS. 5, 6 and 7, the structure for the clamp mechanisms 47, 48 and 49 is shown. The mechanism is mounted to the table 33 by way of bearings 54 having a shaft 56 journaled thereto. Keyed to the shaft 56 is an actuator arm 57 and a clamp arm 58. Power to the actuator arm 57 is provided by a rod 59 and cylinder 61 which operate with a hydraulic system in a conventional manner. As the plunger rod 59 is extended and retracted, the actuator arm 57 causes the clamp arm 58 to be respectively retracted and engaged with the guide rods 51 (or 52) as shown. The clamp arm 58 may have a plurality of holes 62 formed therein to reduce the weight thereof.

The structure which allows the clamp arm 58 to engage the rod 51 can be seen in FIGS. 5–8. The rod 51 has a section 63 with a longitudinally extending slot 64 formed therein. The slot 64 allows for precise lateral and longitudinal positioning of the rod 51 by the clamp arm 58. An insert 66, which is held in the clamp arm 58 by way of a key 67 locked into the opening 68 of the clamp arm 58, extends upwardly into the slot 64 to engage the rod 51. A pin 69 then passes through the clamp arm 58 and the insert 66 to hold the assembly in place. An O-ring 71 is then placed around the clamp arm 58 to hold the pin 69 in place.

The purpose of the insert 66 is to provide for the replaceability of worn parts at a minimal expense. That is, because of the substantial forces that are acting on the clamp arm with the frequent alternating between its engaging and disengaging positions, it becomes necessary to replace worn parts. Further, it is desirable that this can be done without replacing the relatively expensive clamp arm 58 itself. Thus, the insert 66 and its associated securing members.

Installation of the insert 66 into the clamp arm 58 is accomplished as follows. The key 67 is placed into an opening extending transversely through the insert 66, and the combination is installed into the clamp arm 58 by sliding it into the front side (from left to right in FIG. 6) of the clamp arm 58. The pin 69 is then inserted and the O-ring 71 is put into position to cover and retain the pin 69. During operation, it is then the key 67 which takes the wear that results from the translational and torque friction caused by the sequential engagement and disengagement of the insert 66 from the rod 51.

In moving the plate fins along the rods 51 and 52, it will be understood that in the early stages of travel, it is preferable to have a loose fit relationship between the plate fins 11 and the guide rods 51. However, when the plate fins 11 reach the point where they are installed on the hairpin tubes, a more precise positioning is critical, and thus such a loose fit relationship is not practical. Accordingly, the short rods 52 have a transition stage which accounts for this precise positioning requirement.

Figure 9:
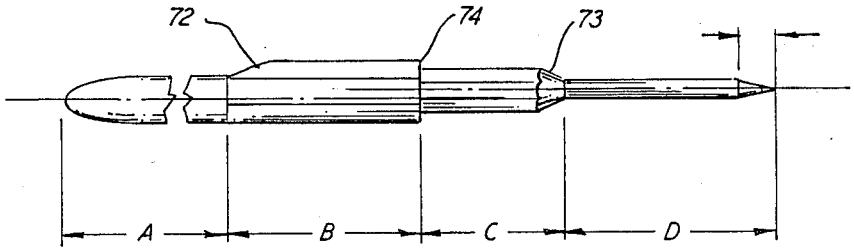
FIG. 9 is a side view of a guide rod showing the various graduated positions thereof.

Referring to FIG. 9, it will be seen that the rod has four different diameters for its four sections A, B, C and D. The A section, which spans most of the length of the rod, is of a relatively small diameter so as to allow the plate fins to easily slide on the rod. As the plate fins approach the end of the rod, at section B, there is a transition surface 72 over which the plate fins 11 pass to arrive at a short length portion of the rod wherein the diameter is at a maximum. At this point, the plate fins have a very close fit relationship with the rod thereby precisely positioning the plate fins for the subsequent transfer to the hairpin tubes. Although this portion is shown as being round, it may be hex-shaped, to provide precise positioning while at the same time allowing the fins to be easily slid over that rod portion. Meanwhile, the hairpin tubes are arriving at the other end, first passing over the small diameter section D and then over the transition surface 73 of gradually increasing diameter to the larger diameter of section C. At this point, there is a very close fit relationship between the rod and the hairpin tube to thereby precisely position the hairpin tube for its subsequent concentric mating with the plate fin bundle. For that purpose, the end of the hairpin tube is brought into abutment with the step 74 of the rod. The maximum outer surface of the hairpin tube is then substantially flush with the outer surface of the rod such that the plate fin bundle can then be easily and smoothly transferred onto the hairpin tubes to complete the lacing operation.

Referring again to FIGS. 3 and 4, a complete cycle of operation will be described. First, the floating rod lacer mechanism receives a predetermined number of plate fins from the fin harvester 32 at zone 1. A programmed quantity of fin stacks will accumulate within this zone, after which time the #1 clamps open and move down below the supporting surface, while the #1 rake comes down to the accumulated fins and moves them into zone 2. The #1 rake then moves back to its original position so that it is ready for the next fin stack, and the #1 clamps rise to the positions where they engage and support the rods 51. Supports 53 are also coordinated to withdraw between each batch of fins received from the harvester 32.

It will be understood that with such an operation, it is critical that the movement of the clamps and rakes be precisely coordinated in order to maintain a continuous flow of plate fins along the rods 51. Accordingly, it is preferable to provide suitable detectors and controls in order to maintain this coordination.

At zone 2, the fins are accumulated until there is precisely the number of fins required for a complete coil. The #2 clamps then open and move down below the supporting surface, and the #2 rake comes down to move the fins to the short rods 52 at zone 3. The #2 rake then returns to its starting position and the #2 clamps rise to their supporting positions.

In addition to the need for coordinating the operation of the clamps such that no two successive clamps are disengaged at any one time, it is also necessary to coordinate the operation of the rakes. In this regard, the #1 rake should be in its starting position when the #2 rake begins to operate.

At zone three, a full bundle of plate fins are isolated, with a short rod 52 being disposed in each one of the plate fin holes. The lower tube sheet is then installed on the rods at the end of the coil bundle. In the meantime, the hairpin tubes have been pushed from the hairpin conveyor at zone 6 and through the hairpin tube section at zone 5. The two groups then come together at zone 4 for the lacing operation.

To initiate the lacing step, the #3 clamps open and move below the support surface, and the #3 rake comes down to move the fin bundle onto the hairpin tubes, after which the #3 rake returns to its starting position and the #3 clamps rise to their supporting positions. The retracting mechanism (not shown) then retracts the hairpin tubes so as to disengage them from the ends of the rods 52. The coil slab is then lowered to the coil conveyor where it passes to the next station.

While a preferred embodiment of the present invention has been depicted and described, it will be appreciated by those skilled in the art that many modifications, substitutions, and changes may be made thereto without departing from the true spirit and scope of the invention. For example, although the invention has been described in terms of use with single row fins, it may also be used with multi-row fins.

What is claimed is:

1. An improved plate fin installing apparatus of the type having a station for harvesting plate fins with laterally spaced holes and a lacing mechanism for axially stacking a plurality of the plate fins on a plurality of parallel tubes, the improvement comprising:

a plurality of guide rods disposed in parallel relationship with their axes in general alignment with the intended direction of movement of the fins;

tube placement means for axially aligning a plurality of tubes with one end of said guide rods;

means for moving the fins onto the other end of said guide rods, along said guide rods and finally off said guide rods one ends and onto the parallel tubes; and support means for said guide rods, said support means being selectively applied to and removed from said guide rods to accommodate the selective movement of the fins along the guide rods while at the same time maintaining the guide rods in their aligned positions.

2. A plate fin installing apparatus as set forth in claim 1, wherein said support means is located under said guide rods and comprises a plurality of arms that are individually applied and removed by moving upwards and downwards, respectively.

3. A plate fin installing apparatus as set forth in claim 2 wherein said plurality of arms are pivotable between their respective upward and downward positions.

4. A plate fin installing apparatus as set forth in claim 2 wherein said guide rods have longitudinally extending slots formed therein for engagement with said support means.

5. A plate fin installing apparatus as set forth in claim 2 wherein, for each of said guide rods, there is at least three support arms and further wherein there is always at least two support arms that are applied at all times.

6. A plate fin installing apparatus as set forth in claim 1 wherein the number of said plurality of guide rods is equal to the number of holes in the plate fins.

7. A plate fin installing apparatus as set forth in claim 1 wherein said plurality of guide rods comprises at least two longer guide rods onto which the fins are initially moved and a plurality of shorter guide rods onto which they are subsequently moved.

8. A plate fin installing apparatus as set forth in claim 1 wherein said guide rods have tapered ends.

9. A plate fin installing apparatus as set forth in claim 1 wherein said means for moving the fins comprises a plurality of rake mechanisms which operate successively with each one moving the plate fins between adjacent zones.

10. A plate fin installing apparatus as set forth in claim 9 wherein said support means is removed to allow a first rake to move a predetermined number of plate fins from a first to a second zone.

11. A plate fin installing apparatus as set forth in claim 9 wherein the total number of plate fins required for a complete coil is accumulated in a second zone.

12. A plate fin installing apparatus as set forth in claim 9 wherein, when the plate fins are moved into a third zone, they are engaged with additional guide rods such that there is guide rod disposed in each of the laterally spaced holes in the plate fin.

13. A plate fin installing apparatus as set forth in claim 9 wherein there is a support means and a rake mechanism for each zone and further wherein the support means and rake mechanisms are coordinated such that when the support means is removed, its associated rake mechanism operates to move the plate fins into the next zone.

14. Apparatus for lacing a plurality of hairpin tubes into a bundle of plate fins having holes formed therein comprising:

a plurality of guide rods disposed in parallel relationship with their axes being in substantial coincidence with respective lacing axes at one end thereof;

support means for supporting and maintaining said rods in their fixed positions;

tube handling means for advancing a plurality of parallel hairpin tubes, while maintaining their axes in alignment with said lacing axes, until they engage said plurality of rods at their one ends; and fin handling means for placing a plurality of plate fins on the other end of said plurality of guide rods, with said guide rods passing through the plate fin holes, and for transversely sliding said plate fins along the length of said guide rods, off said rods one ends and onto said hairpin tubes.

15. Lacing apparatus as set forth in claim 14 wherein said support means comprises a plurality of support arms which are individually and selectively applied to and removed from said guide rods to accommodate the selective movement of the fins along said guide rods while at the same time maintaining said guide rods in their aligned positions.

16. Lacing apparatus as set forth in claim 15 wherein said support means is located under said guide rods and further wherein said plurality of arms are individually applied and removed by being moved upwardly and downwardly, respectively.

17. Lacing apparatus as set forth in claim 16 wherein said plurality of arms are pivotable between their upward and downward positions.

18. Lacing apparatus as set forth in claim 14 wherein said guide rods are tapered at their ends.

19. Lacing apparatus as set forth in claim 18 wherein said tapered guide rods are engaged with said hairpin tubes by extending into said hairpen tubes.

20. Lacing apparatus as set forth in claim 19 wherein said guide rods include a transition portion over which the hairpin tubes pass when moving from a smaller diameter portion to a larger diameter portion.

21. Lacing apparatus as set forth in claim 19 wherein said guide rods include a step portion which abruptly changes from a larger to a smaller diameter, such that when said hairpin tubes are engaged with said guide rods, the ends of the hairpin tubes abut against said step portion to thereby provide a substantially continuous surface of equal diameter where the plate fins pass from said guide rods larger diameter to the outer surface of the hairpin tubes.

22. Lacing apparatus as set forth in claim 14 wherein said guide rods include a transition portion over which the plate fins pass while moving from a small diameter portion to a larger diameter portion.

23. A method of lacing a plurality of hairpin tubes into a bundle of plate fins having holes formed therein comprising the steps of:

supporting a plurality of guide rods in parallel relationship with their axes being in substantial coincidence with respective lacing axes at one end thereof;

placing a plurality of plate fins on the other end of said plurality of guide rods with said guide rods passing through the plate fin holes;

while maintaining their axes in alignment with said lacing axes, advancing a plurality of parallel hairpin tubes until they engage said plurality of guide rods at their respective one ends; and sliding said plate fins along the length of said guide rods, off said one ends and onto said hairpin tubes.

24. A method as set forth in claim 23 wherein the supporting step is accomplished by providing a plurality of support arms which are individually and selectively applied to and removed from said guide rods to accommodate the sliding of the fins along the guide rods while at the same time maintaining the guide rods and their aligned positions.

25. A method as set forth in claim 23 wherein said step of sliding said plate fins is accomplished by using a plurality of rake mechanisms with each such rake mechanism operating within a zone, and with the rake mechanisms being individually and selectively applied to move the plate fins between their respective zones.

26. A method as set forth in claim 25 wherein said supporting and sliding steps are coordinated such that within a particular zone, the supporting structure is temporarily removed to allow the associated rake mechanism to move the plate fins over that portion of the guide rod which was previously supported by the support structure.

* * * * *